US006322483B1

(12) United States Patent
Rotella

(10) Patent No.: US 6,322,483 B1
(45) Date of Patent: Nov. 27, 2001

(54) ADJUSTABLE STRAP AND BAND EXERCISE DEVICE MOUNTABLE ON DOOR

(76) Inventor: Frank A. Rotella, 5 Ranch Rd., Upper Saddle River, NJ (US) 07458

( * ) Notice: Subject to any disclaimer, the term of this patent is extended or adjusted under 35 U.S.C. 154(b) by 0 days.

(21) Appl. No.: 09/538,317

(22) Filed: Mar. 30, 2000

Related U.S. Application Data

(60) Provisional application No. 60/134,348, filed on May 14, 1999.

(51) Int. Cl.[7] ..... A63B 21/04

(52) U.S. Cl. ..... 482/129; 482/121; 482/126

(58) Field of Search ..... 482/129, 904, 482/907, 126, 121, 124

(56) References Cited

U.S. PATENT DOCUMENTS

| | | | |
|---|---|---|---|
| 680,556 | 8/1901 | Wieland . | |
| 704,840 | 7/1902 | Korth et al. . | |
| 3,256,015 | 6/1966 | Perrin . | |
| 3,707,284 | 12/1972 | Waldeck . | |
| 4,229,001 | 10/1980 | Roman . | |
| 4,830,365 | 5/1989 | March . | |
| 5,186,698 | 2/1993 | Mason et al. | 482/79 |
| 5,203,754 | 4/1993 | Maclean | 482/124 |
| 5,209,712 | 5/1993 | Ferri . | |
| 5,253,639 | 10/1993 | Johnston . | |
| 5,254,065 | 10/1993 | Pollock . | |
| 5,277,683 | 1/1994 | Wilkins | 482/129 |
| 5,306,222 | 4/1994 | Wilkinson | 482/124 |
| 5,336,151 | 8/1994 | Van Ballegooie | 482/124 |
| 5,451,194 | 9/1995 | Harrigan | 482/70 |
| 5,571,064 | 11/1996 | Holm . | |
| 5,582,579 | 12/1996 | Chism et al. | 601/27 |
| 5,599,260 | 2/1997 | Rovinsky et al. | 482/121 |
| 5,601,518 | 2/1997 | Weintraub . | |
| 5,624,360 | 4/1997 | Wilkins | 482/129 |
| 5,643,159 | 7/1997 | Iavarone | 482/125 |
| 5,662,563 | 9/1997 | Maerzke . | |
| 5,766,118 | 6/1998 | Conner . | |
| 5,782,727 | 7/1998 | Pierce | 482/129 |
| 5,807,214 | 9/1998 | Riazi . | |
| 5,839,994 | 11/1998 | Elbogen . | |
| 5,921,900 | 7/1999 | Mankovitz | 482/121 |
| 5,935,047 | 8/1999 | Cawley | 482/79 |

*Primary Examiner*—Jerome Donnelly
(74) *Attorney, Agent, or Firm*—Levisohn, Lerner, Berger & Langsam

(57) ABSTRACT

A portable and light weight exercise device comprising an adjustable nylon strap which has a series of nylon loops along one side, that side being of a length equal to the height of a door, and the adjustable nylon strap having affixed thereto on the side opposite the side having the nylon loops, a locking mechanism that allows for adjustment of the length of the adjustable nylon strap so that the adjustable strap may be positioned to encircle the height of the door. An elastic band is passed through a selected loop in the series of loops on the adjustable nylon strap. The user pushes or pulls the elastic band passed through a loop to exercise a wide range of muscle groups.

4 Claims, 14 Drawing Sheets

ADJUSTABLE STRAP AND BAND EXERCISE DEVICE MOUNTABLE ON DOOR

This appln claims benefit of Prov. No. 60/134,348 filed May 14, 1999.

FIELD OF THE INVENTION

The invention relates to an exercise device having an adjustable strap which is mountable on a door or wall, and an elastic band. More particularly, the adjustable strap includes a series of loops on one of its sides. Once the adjustable strap has been mounted on a door or wall, an elastic band can be placed through one of the loops and can be pulled or pushed to exercise various muscles.

BACKGROUND OF THE INVENTION

Devices are known in the art which may be used to exercise muscles. These devices, however, have limitations, such as, by way of example only, lack of portability, heavy weight, large size, inconvenient storage, incompatibility, lack of adaptability to different users and/or restriction on muscle groups exercised.

One such apparatus is described in U.S. Pat. No. 5,766,118 issued Jun. 16, 1998 to Conner. The Conner apparatus is used for developing the abdominal muscle group. The Conner apparatus attaches to a vertical surface such as a door or wall using a clamp and includes an elastic resistance band which is formed into a closed loop and a harness which is pulled to exercise the muscles.

U.S. Pat. No. 5,601,518 issued Feb. 11, 1997 to Weintraub discloses a portable exercise device that comprises two bases. Each of these bases attaches to the top and bottom of a door respectively. A bar is pivotally mounted to the bottom base. The bar is attached to a strap on one end and a longitudinally extending biasing means on the other. By pulling on a rod attached to the strap, the user can exercise his or her muscles.

U.S. Pat. No. 5,571,064 issued Nov. 5, 1996 to Holm discloses an exercise device which includes a loop for attachment to an anchoring structure, such as a door, which loop receives an elastic cord, which elastic cord is connected to a handle assembly.

U.S. Pat. No. 5,254,065 issued on Oct. 19, 1993 to Pollock discloses a fastening strap configured as a loop securable between a door and its associated frame. The strap is used for support of exercise.

U.S. Pat. No. 4,830,365 issued on May 16, 1989 to March discloses an exercise device for home use for attachment to a suitable surface, such as a door, having a vertical tubular housing with spring mechanism and molded piston assembly inside, to which is attached a rope with various handle means for exercise.

U.S. Pat. No. 5, 662,563 issued on Sep. 2, 1997 to Maerzke discloses a portable exercise device comprising a flexible elastic material strap gripped by three rods held together by removable caps at each end.

It is apparent that an exercise apparatus that overcomes one or more of the limitations of the exercise apparatus described above would be advantageous.

SUMMARY OF THE INVENTION

The invention is an adjustable strap and band exercise device which is mountable on a door, wall or suitable structure. More particularly, the invention comprises an adjustable strap with a series of loops which may be mounted on a door through a locking mechanism, and an elastic band which is insertable through a selected loop of the adjustable strap. The adjustable strap includes a series of loops on one of its sides. After the adjustable strap has been mounted on the door by use of the locking mechanism, the door is closed and preferably locked, and an elastic band can be placed through one of the loops of the adjustable strap. The user may select an appropriate loop of the adjustable strap through which to pass the elastic band based on the user's height or the muscle group which the user desires to exercise. The user may exercise by applying force to the adjustable strap. Before or after use of the invention, the adjustable strap of the invention may be rolled up to a compact size whereby it may be conveniently carried by a person in his or her pocket.

Accordingly, it is an object of the invention to provide an exercise apparatus which is portable, light weight, compactable and adaptable to be used by people of different sizes and physical strengths.

It is a further object of the invention to provide an exercise apparatus which works a wide range of muscle groups.

It is a further object of the invention to provide an exercise apparatus which is flexible and of inexpensive design.

BRIEF DESCRIPTION OF THE DRAWINGS

The method and apparatus of the present invention will now be described with reference to the accompanying drawing figures, in which.

DETAILED DESCRIPTION OF THE PREFERRED EMBODIMENTS

Figure 1:
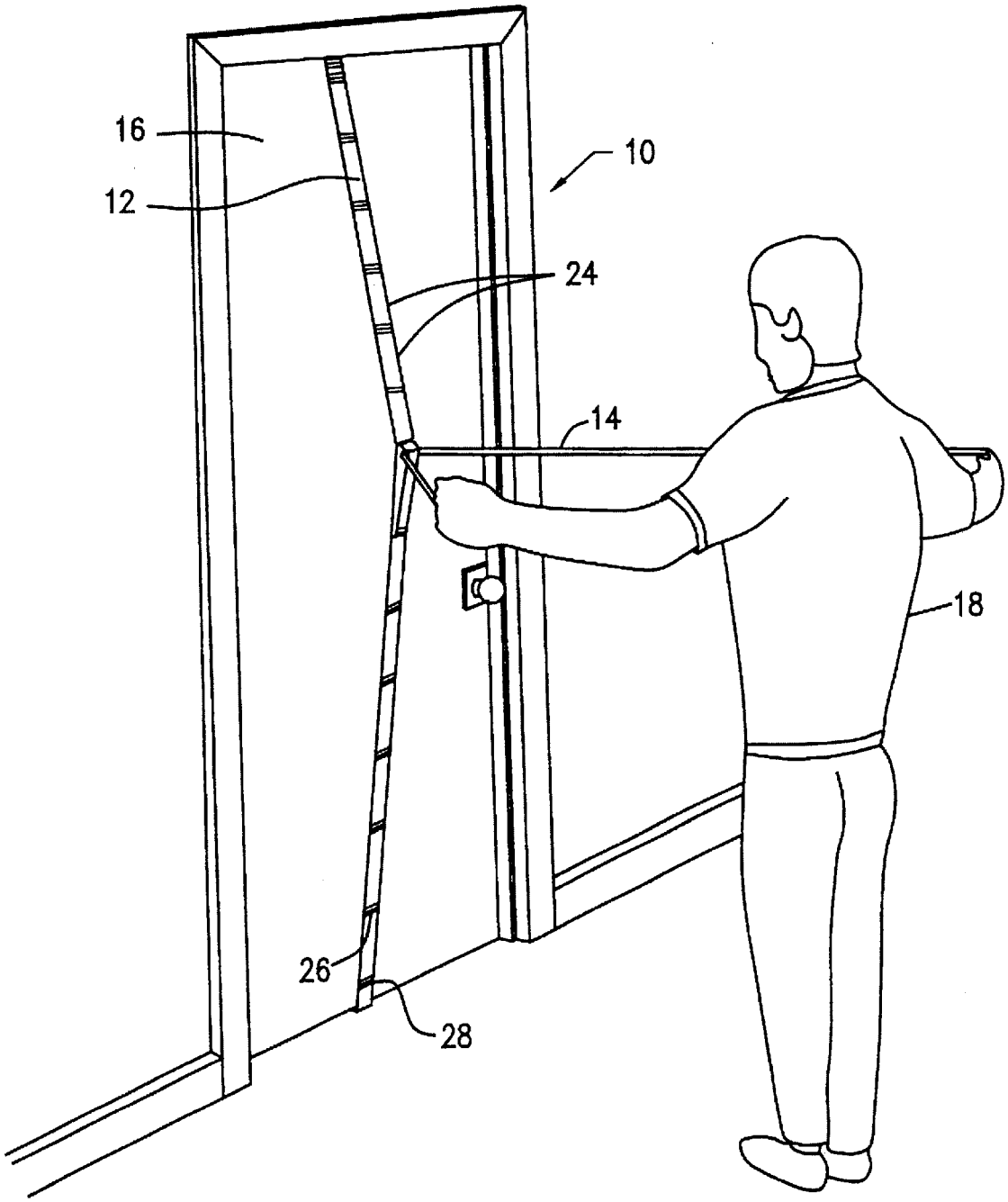
FIG. 1 is a perspective view of an embodiment of the present invention, showing the invention in use by a standing man holding in each hand one end of the elastic band passed through a loop of the adjustable strap.
Figure 4:
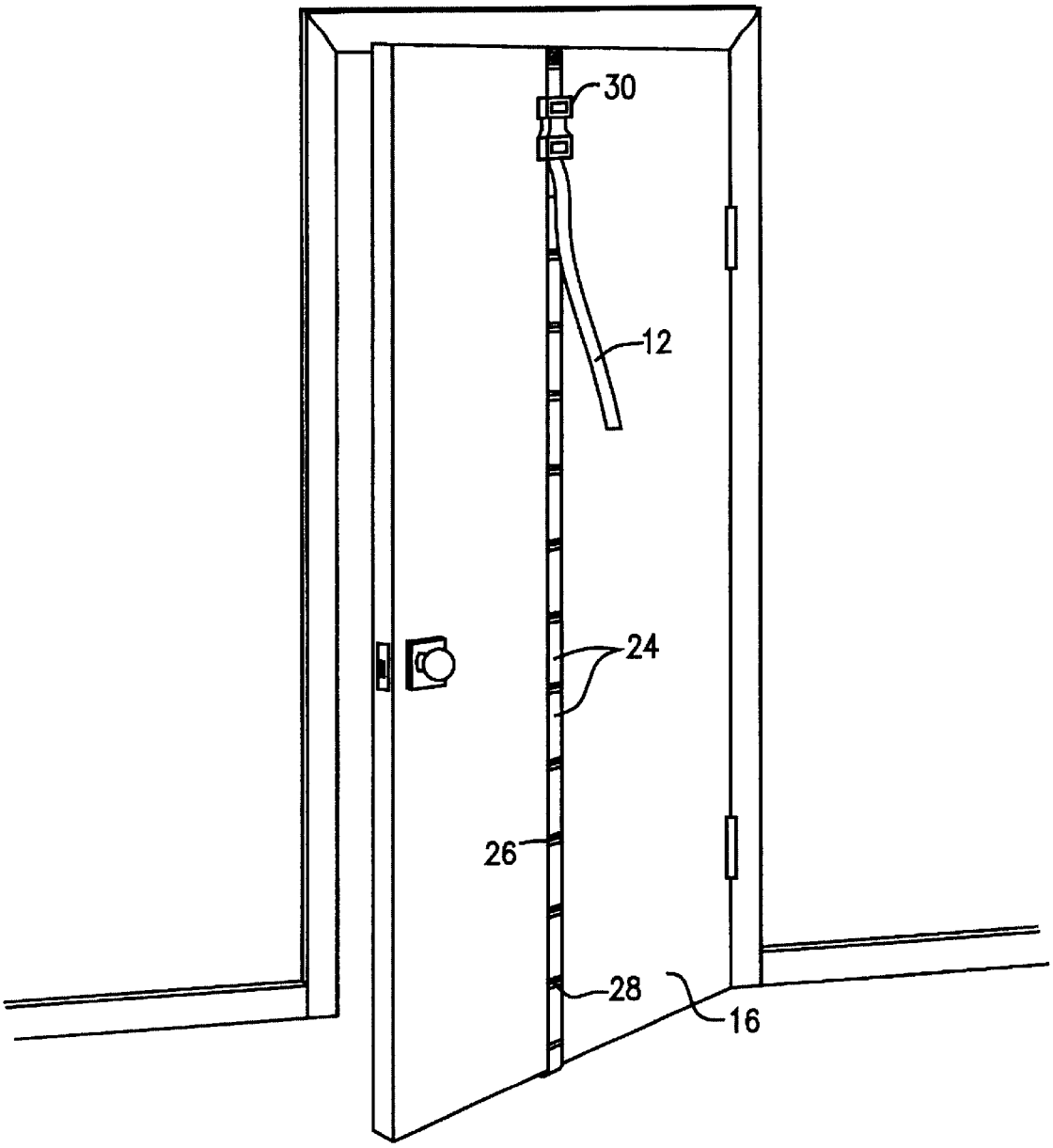
FIG. 4 is a front view of an embodiment of a portion of the present invention showing the adjustable strap with lock as attached to an open door.
Figure 5:
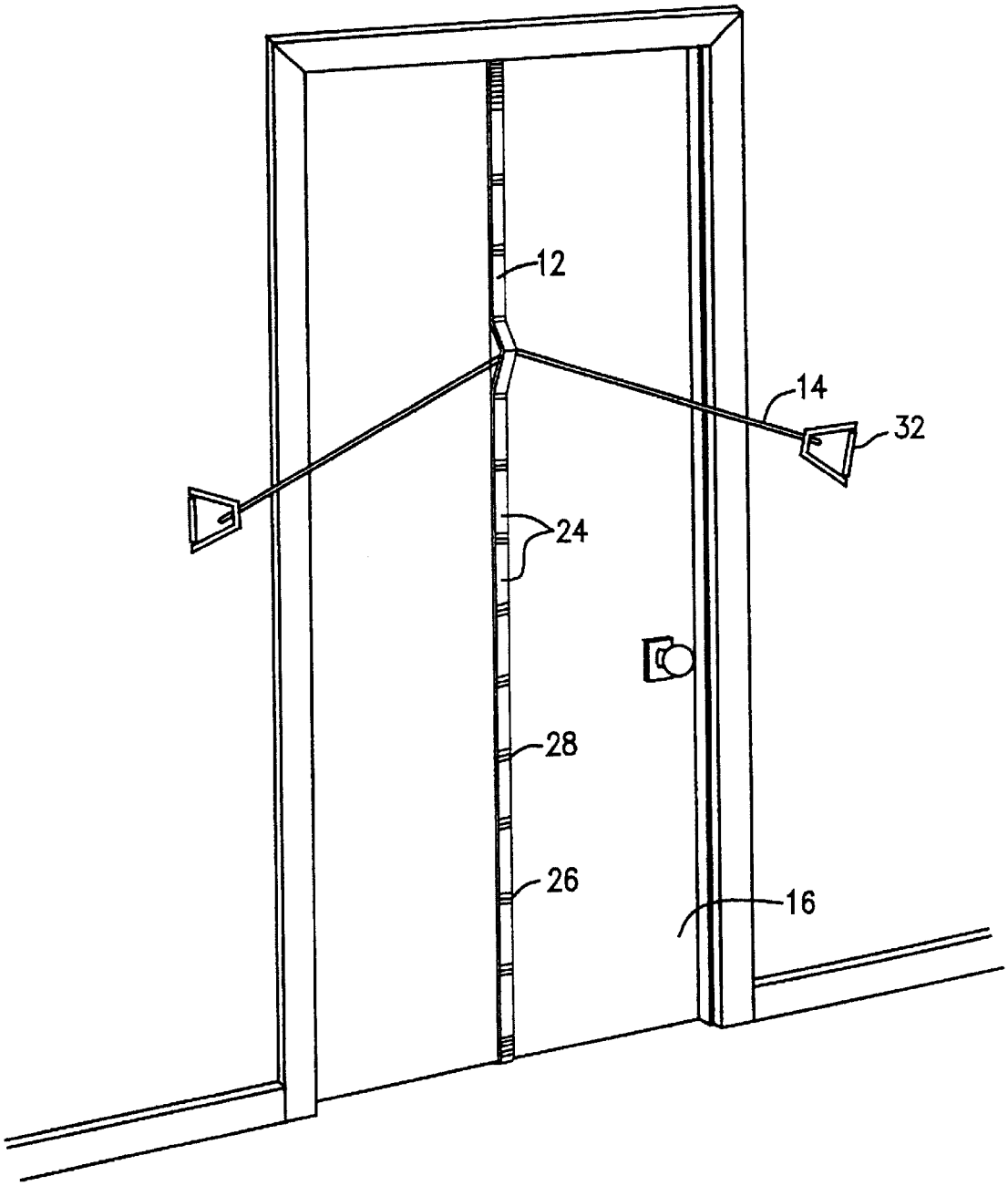
FIG. 5 is a front perspective view of an embodiment of the present invention showing the adjustable strap with lock as attached to a closed door with the elastic band passed through one of the loops of the adjustable strap.

Turning initially to FIG. 1 there is illustrated a portion of an embodiment of the adjustable strap and band exercise device mountable on a door (10). The adjustable strap and band exercise device comprises, as shown in FIG. 1 and FIG. 4, an adjustable strap (12), a band (14) and a locking mechanism (30). The adjustable strap (12) comprises a plurality of loops (24). In use an elastic band (14) is threaded through a loop (24) of the adjustable strap, which loop is selected at the option of the user (18).The elastic band (14), an exercise band, is known in the art and may be formed of rubber. Preferably, a plurality of rubber exercise bands or other elastic bands of various tensions may be employed at different times by the user of the adjustable strap and exercise device in order for the user to select and take advantage of the specific tension of any particular elastic band.

The adjustable strap (12) preferably is made of nylon and may be made of a heavy-duty low stretch flat nylon webbing. In one embodiment of the adjustable strap it is preferably approximately 1 inch wide and approximately 17.5 feet long. In this embodiment the adjustable strap (12) is dimensioned so that it fits vertically around a door (16).

However, the adjustable strap (12) may be of other dimension of length and width. For example, the adjustable strap may be dimensioned to fit to a specialized wall mount or other mounting structure (not shown).

As another example, the adjustable strap may be dimensioned to attach to the top and bottom of a door without circling the length of the door. In such an embodiment the adjustable strap may be attached at both ends to a "U" shaped clip sized to fit snugly to the bottom and top of the door. Either "U" shaped clip may be provided with a means of adjustment, as known in the art, which allows the adjustable strap to be lengthened or shortened to properly fit to the door or mounting structure.

The adjustable strap (12) is constructed so that it can be rolled up and conveniently carried by a person when not in use.

Figure 2A:
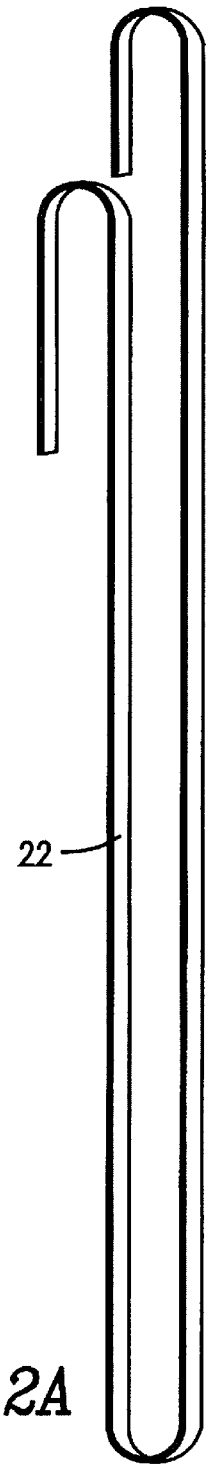
FIG. 2A is a perspective view of a portion of the present invention before completion of its manufacture showing the long portion of the adjustable strap before the short portion of the adjustable strap is sewn into it.
Figure 2B:
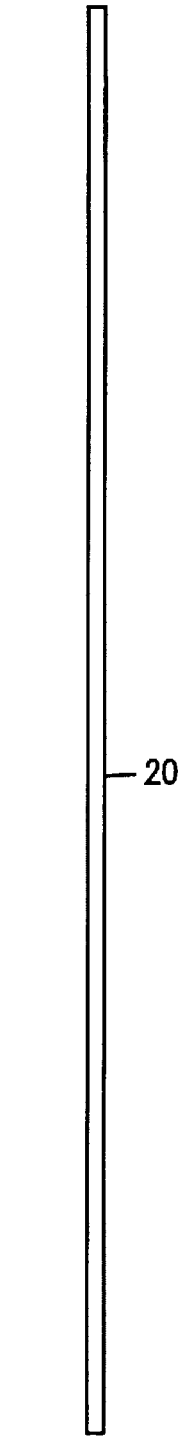
FIG. 2B is a front view of a portion of the present invention before completion of its manufacture showing the short portion of the adjustable strap before it is sewn into the long portion of the adjustable strap.
Figure 2C:
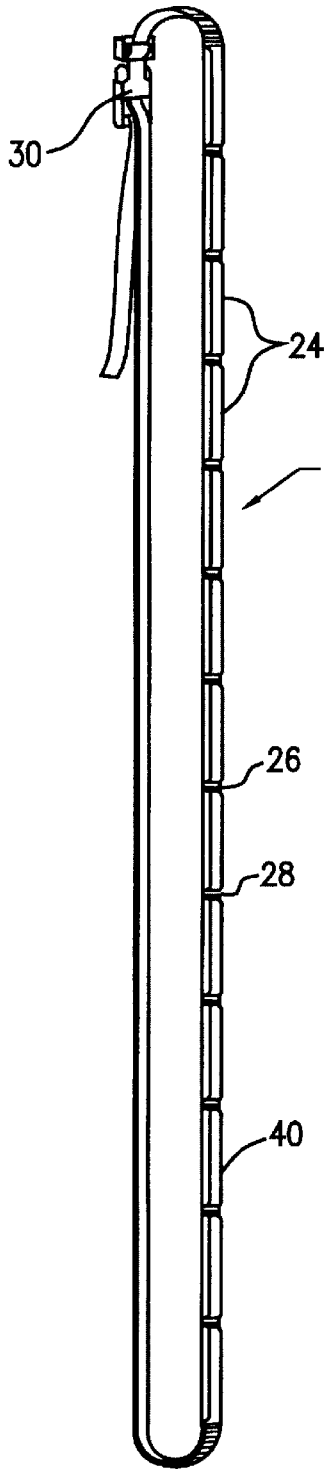
FIG. 2C is a perspective view of the adjustable strap shown with a lock sewn to a loop near one end of the adjustable strap.
Figure 2D:
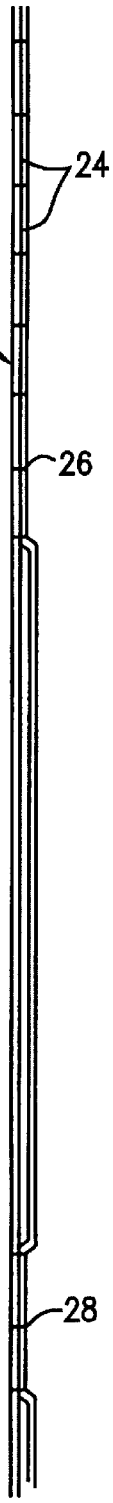
FIG. 2D is a side view of a portion of the present invention showing a partial enlargement of a section of the strap, and showing an enlarged view of one of the adjustable strap's loops.
Figure 2E:
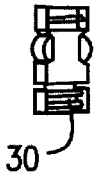
Figure 3A:
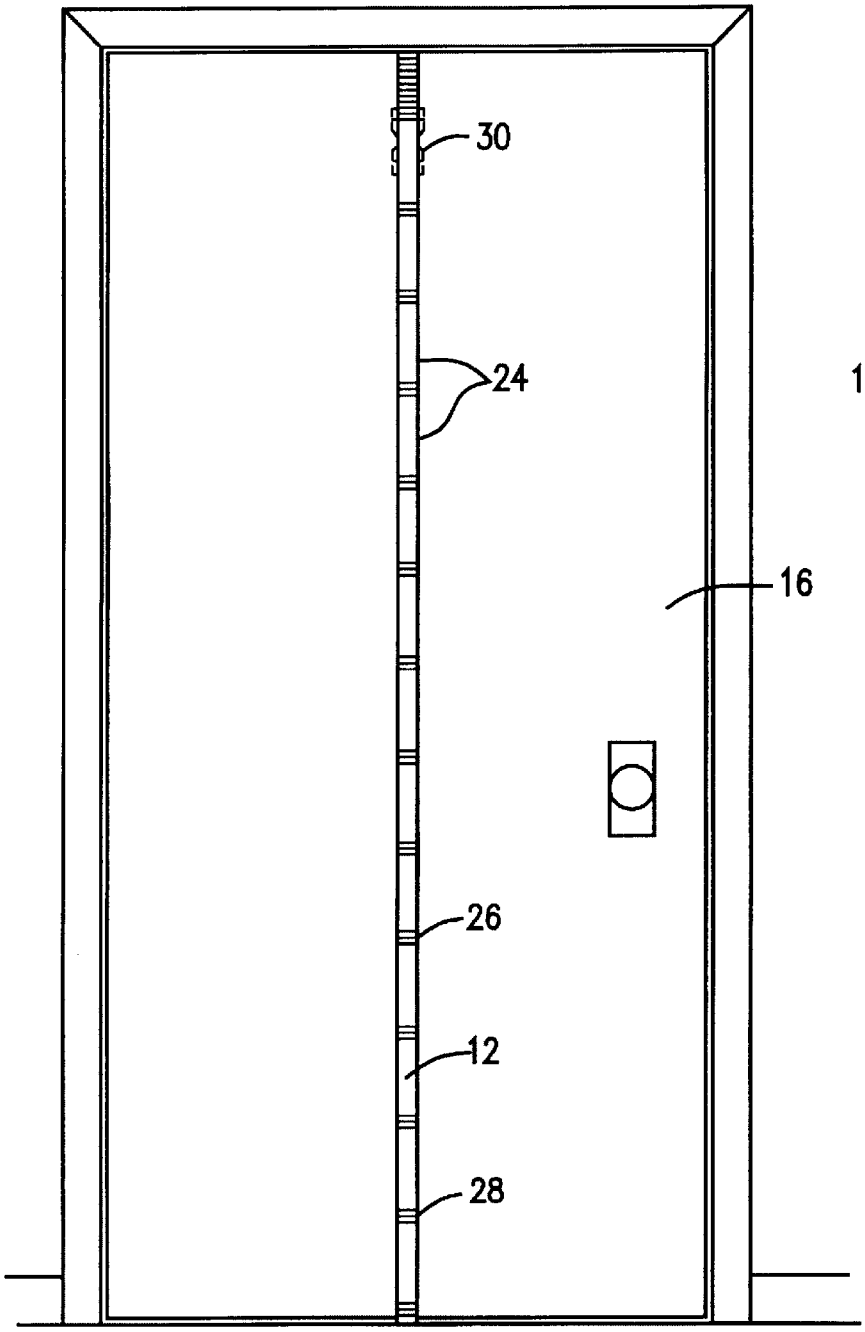
FIG. 3A is a front view of an embodiment of a portion of the present invention showing the adjustable strap with lock as attached to a closed door.
Figure 3B:
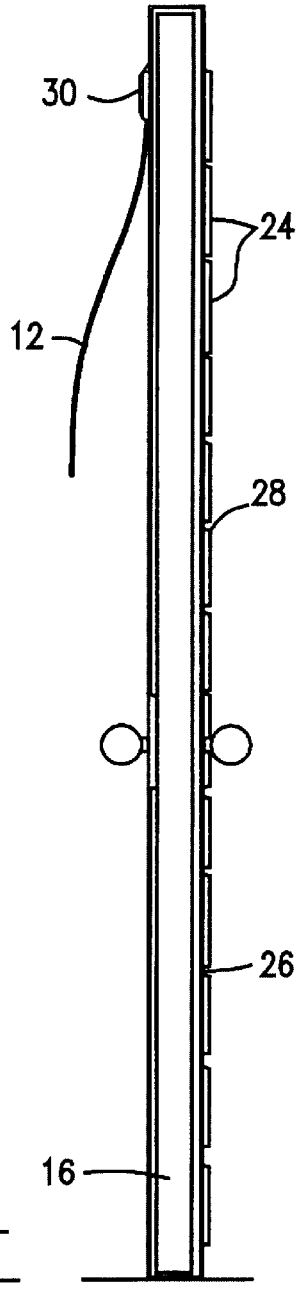
FIG. 3B is a side view of an embodiment of a portion of the present invention showing the adjustable strap with lock as attached to a closed door.

In a preferred embodiment the adjustable strap (12) may be formed by attaching a short piece (20), as illustrated in FIG. 2B to a long piece (22), shown in FIG. 2A. Preferably, the short piece (20) is of approximately 1/16 inch thickness and is approximately 7 feet in length. Preferably, the long piece (22) is of approximately 1/16 inch thickness and approximately 17.5 feet in length. Preferably, both the short piece and the long piece are of approximately the same width, preferably 1 inch wide. Preferably, the adjustable strap (120) is not of such great thickness to prevent its passage through the space formed by the top of the door and the door frame when the door is in an open position and will allow the door to be closed with the adjustable strap (120) so positioned. Both the short piece and the long piece may be heavy-duty low stretch flat nylon webbing. In one embodiment the 7 foot short piece is sewn onto the 17.5 foot long piece to form two overlapping pieces of nylon. The two overlapping pieces of nylon are sewn together to form a series of loops (24) on one side of the adjustable strap (12), as shown in FIG. 2C. Preferably each loop (24) is approximately five inches in length and separated from the adjacent loop by preferably three rows of stitches (26) which may be located within approximately a one inch segment (28). Preferably, at the top and bottom of the series of loops, there are multiple rows of stitches connecting the short piece (20) and the long piece (22). The threads used to sew the overlapping short piece (20) and long piece (22) together may be heavy duty nylon threads, such as nylon #69, nylon 138 or nylon 92. The short piece (20) and long piece (22) may be sewn together by use of an industrial sewing machine. After manufacture, the adjustable strap (12) is preferably one continuous heavy duty nylon piece.

In another embodiment the adjustable strap is 28 feet long and fits vertically around a lockable door or other suitable means of attachment. Approximately, one half of the adjustable strap is folded back upon itself and then the overlapping pieces are sewn together at approximately equidistant lengths to form a series of loops. Each of said loops is approximately four to five inches long. Preferably, there are multiple rows of stitches within approximately a one inch area between each loop. Preferably, at the top and bottom of the series of loops, there are multiple rows of stitches connecting the overlapping pieces of the adjustable strap.

Figure 12:
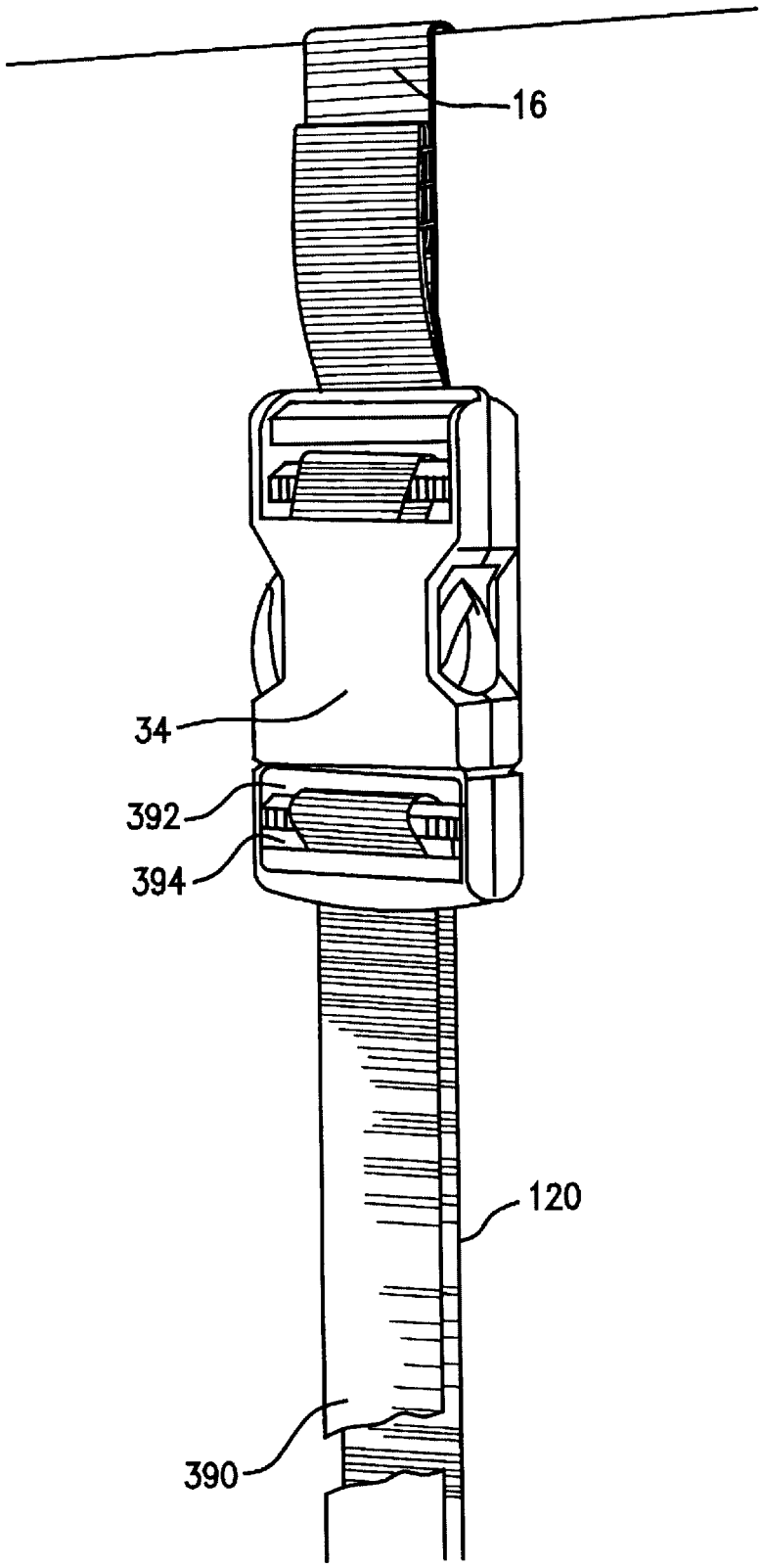
FIG. 12 is a frontal view of a portion of the invention shown in FIG. 11B.

The adjustable strap may be secured to a door by a locking mechanism (30). The adjustable strap is secured to a door so that the loops (24) are positioned on the side of the door where the user of the device will be positioned. In a preferred embodiment the adjustable strap is positioned to circle the height of the door and the locking mechanism is preferably located on the opposite side of the door from where the user of the device will be positioned. The locking mechanism (30) may comprise a locking mechanism known in the art, such as, a three or four opening plastic tension lock, a side release plastic clip, which may be made of acetyl, or a side release buckle (34), as shown in FIGS. 6A, 6B and 12.

Figure 6A:
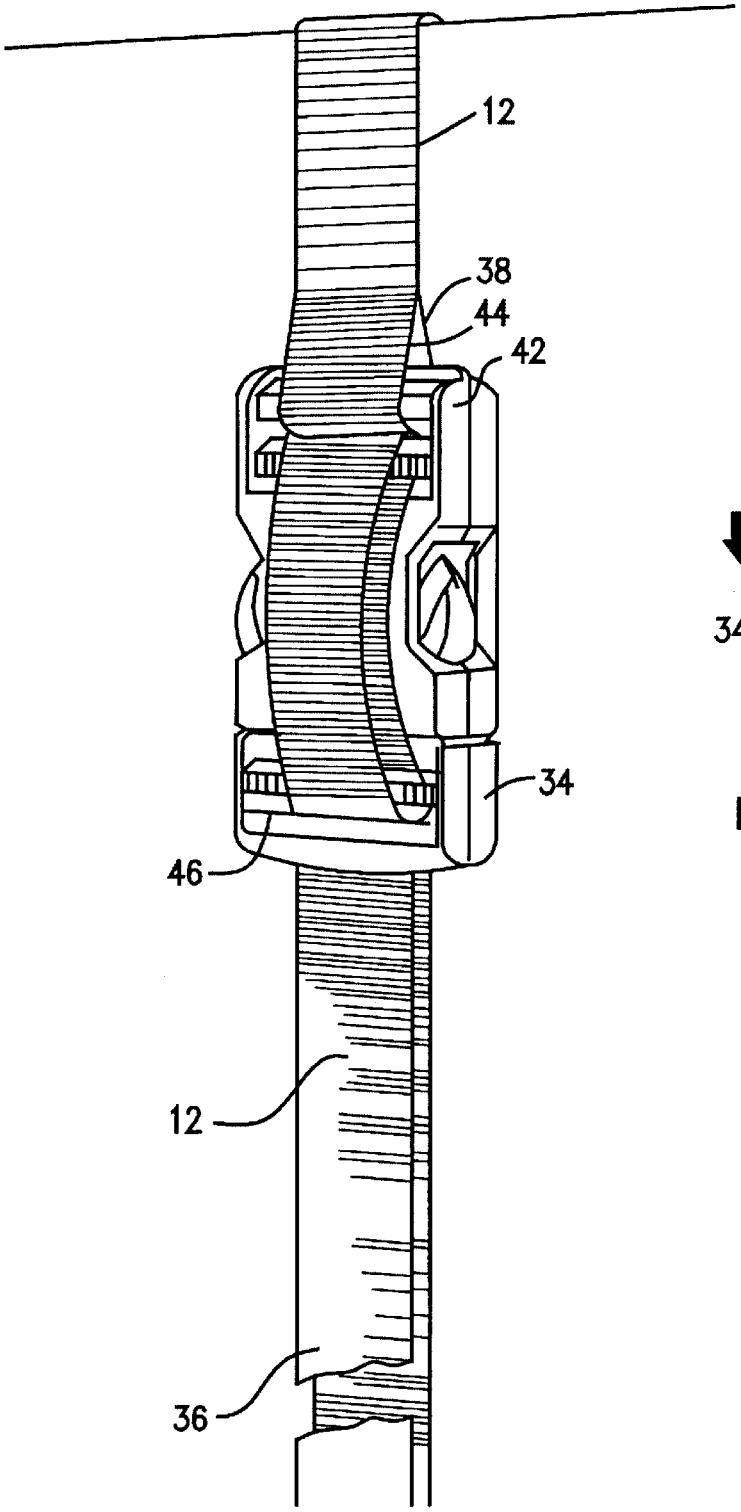
FIG. 6A is a perspective view of a portion of the invention showing a portion of the adjustable strap with lock.
Figure 6B:
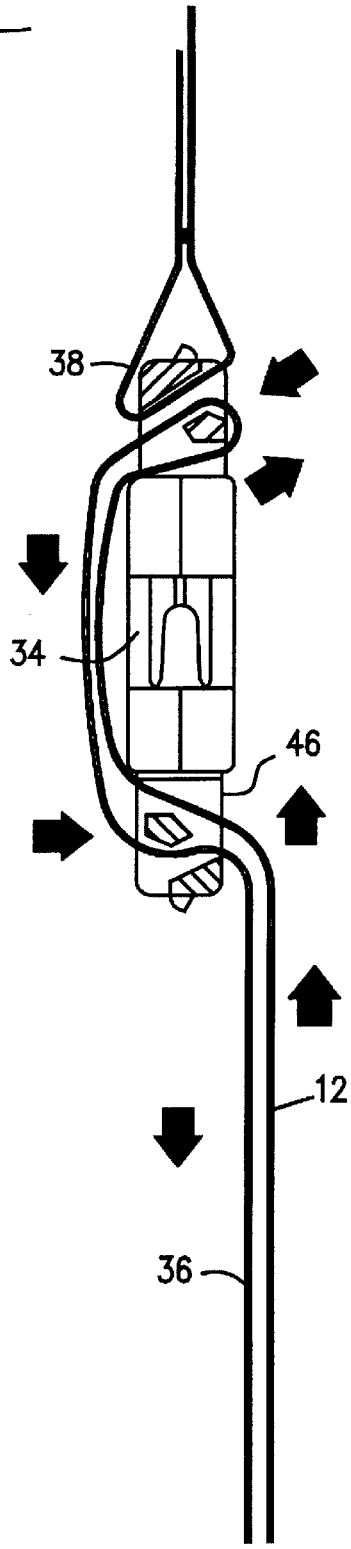
FIG. 6B is a cross sectional view of the portion of the invention shown in FIG. 6A.
Figure 7:
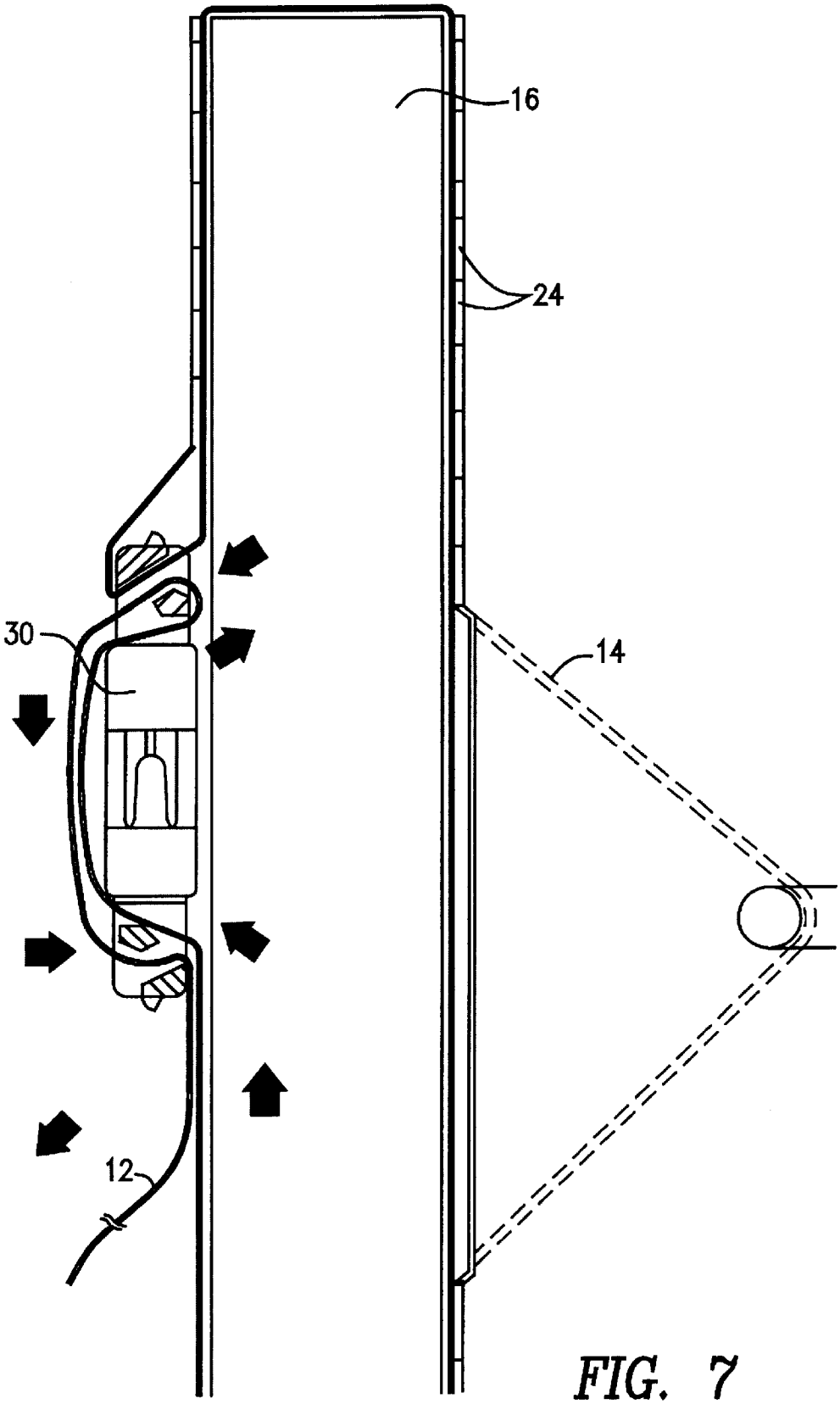
FIG. 7 is a cross sectional view of the portion of the invention showing a portion of the adjustable strap passed through the lock and showing a portion of the elastic band passed through a loop of the adjustable strap causing a change in position of the loop of the adjustable strap.
Figure 8:
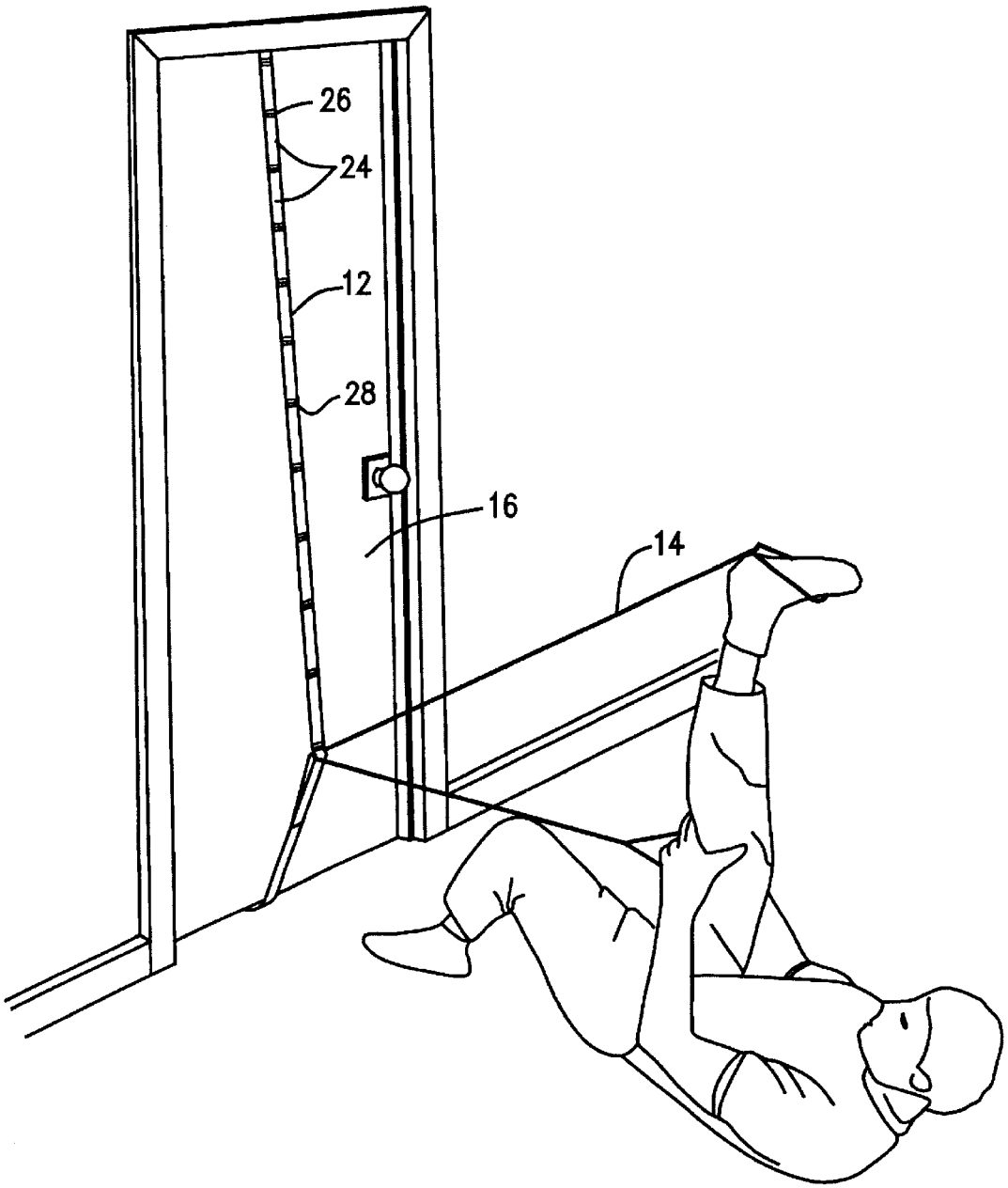
FIG. 8 is a perspective view of an embodiment of the present invention, showing the invention in use by a reclining man.
Figure 9A:
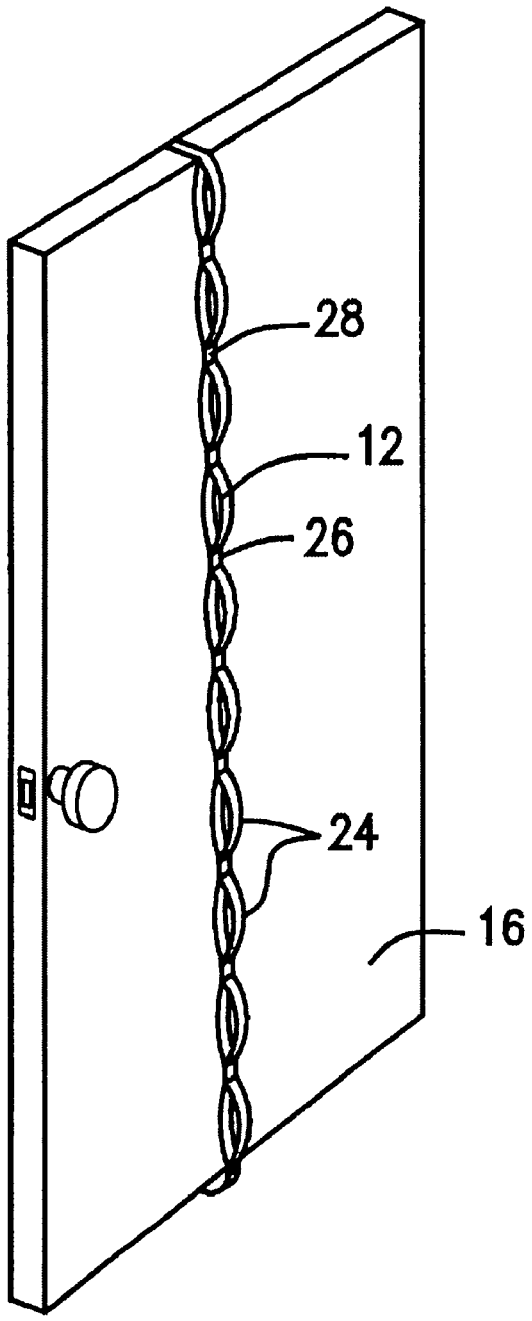
FIG. 9A is a perspective view of another embodiment of a portion of the present invention shown without the elastic band.
Figure 9B:
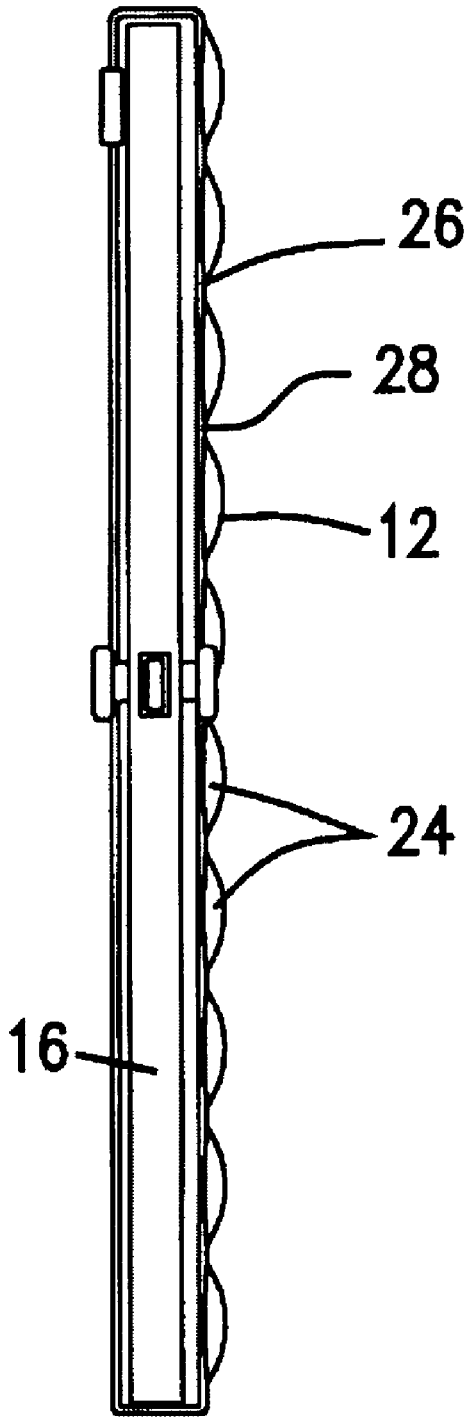
FIG. 9B is a side view of the embodiment of the portion of the present invention of FIG. 9A without the elastic band.
Figure 10A:
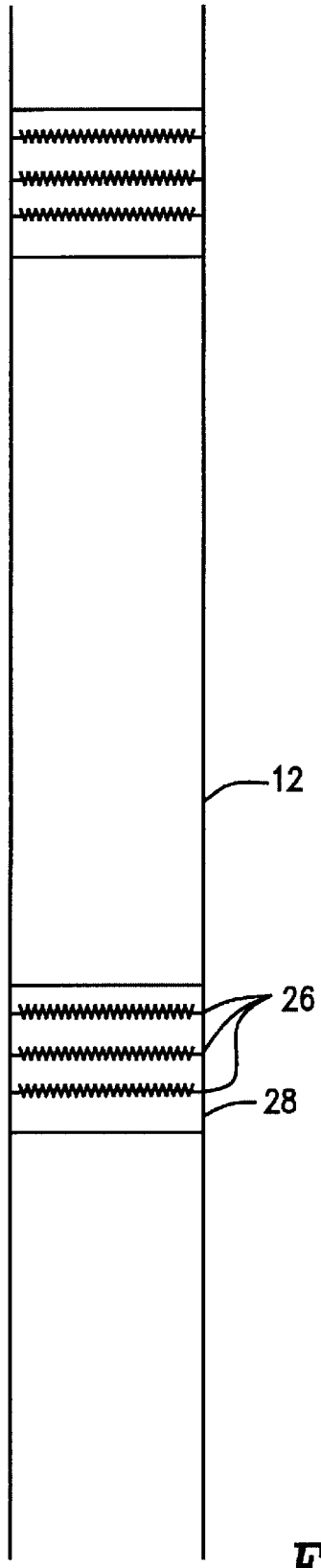
FIG. 10A is a front view of a portion of the present invention showing a portion of the adjustable strap.
Figure 10B:
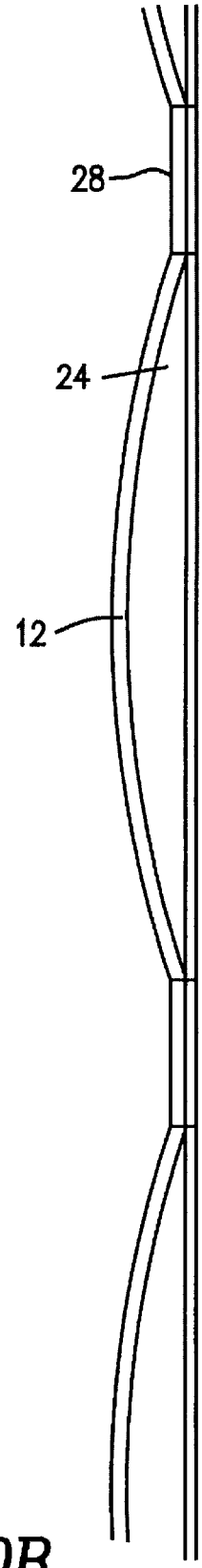
FIG. 10B is a side view of a portion of the present invention showing a portion of the adjustable strap.

In a preferred embodiment, as shown in FIG. 6A, a first portion (42) of the side release buckle (34) is attached to the adjustable strap (12) by sewing with multiple rows of stitching so that an end loop (38) is formed at one end of the adjustable strap (12) and the first portion (42) of the side release buckle (34) is secured in the opening (44) formed by the loop (38). Heavy duty nylon threads, such as nylon #69, nylon 138 and nylon 92 may be used to sew the tension lock to the adjustable strap and to form the multiple rows of stitching (26) between the loops. An industrial sewing machine may be used to sew any stitching where heavy duty nylon thread is used. As shown in FIG. 6B, the free end (36) of the adjustable strap may be threaded through a second portion (46) of the side release buckle (34), as is known in the use of a side release buckle (34). Thus, by pulling on the free end (36) of the adjustable strap the adjustable strap may be shortened. The adjustable strap may also be lengthened by use of the side release buckle, as known in the art. After the adjustable strap has been placed around a door, by pulling on the free end (36) of the adjustable strap, the adjustable strap may be tightened to be secured against the door (16). The adjustable strap is adjusted by the user to the size of the door or wall unit to form a circle around the door or wall unit.

Figure 11A:
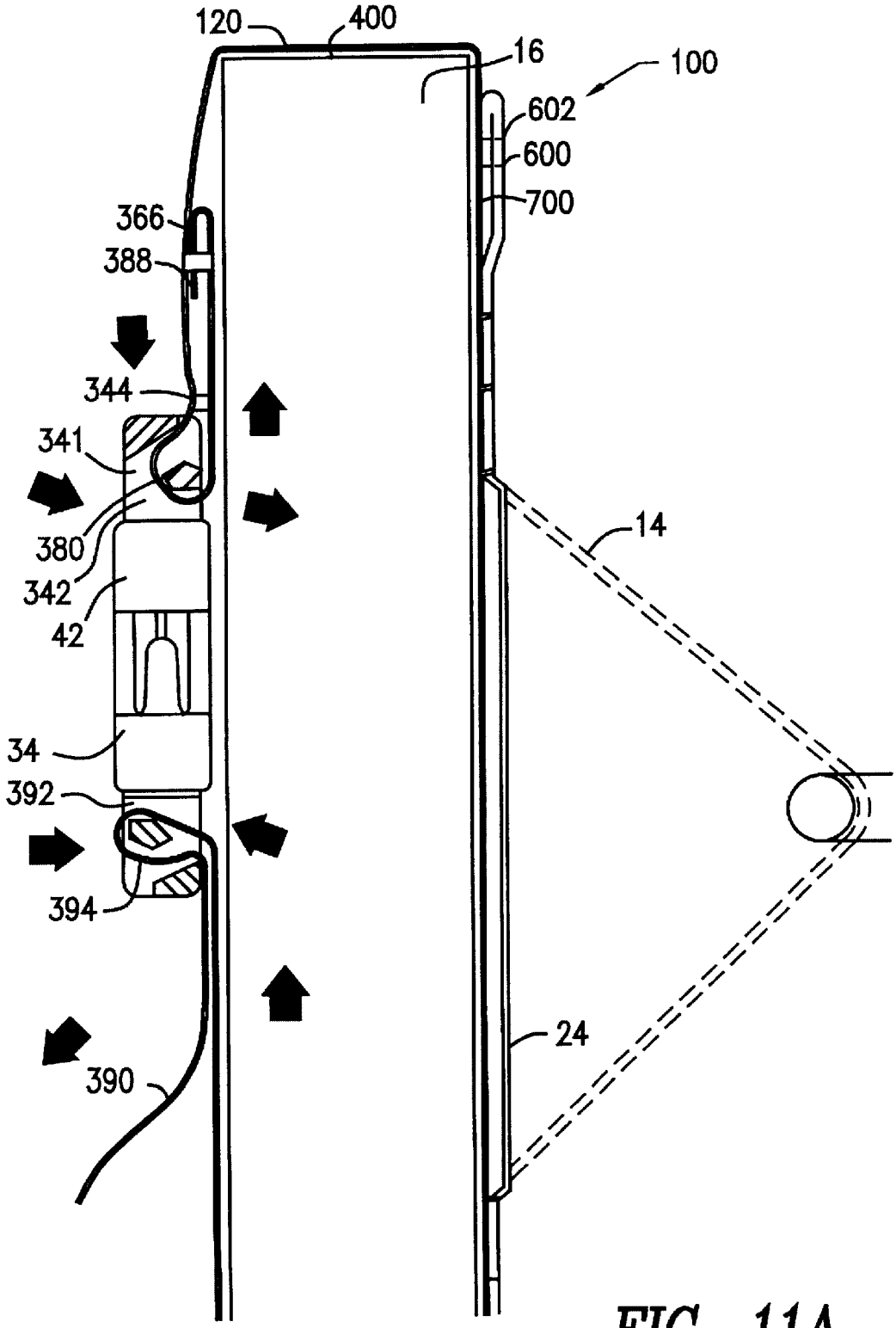
FIG. 11A is a cross sectional view of a portion of an embodiment of the invention, showing the adjustable strap, an embodiment of the stops and a lock, as attached to the door.
Figure 11B:
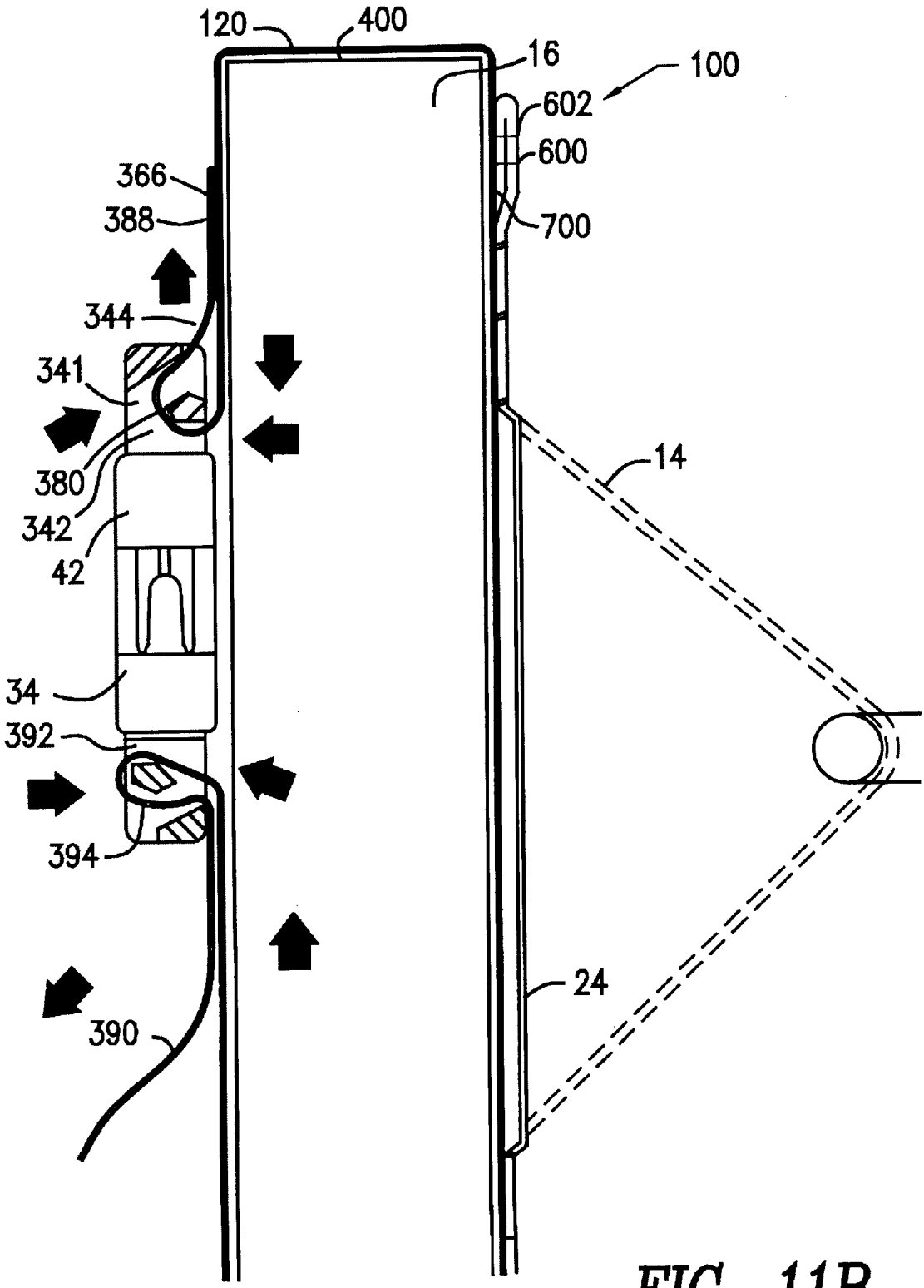
FIG. 11B is a cross sectional view of a portion of an embodiment of the invention, showing the adjustable strap with another embodiment of the stops and a lock, as attached to the door.

Turning to FIG. 11B there is illustrated a portion of an embodiment of the adjustable strap, with an embodiment of the stops, and band exercise device (100) mountable on a door (16). In the embodiment shown in FIG. 11B, the adjustable strap and band exercise device comprises, an adjustable strap (120), a band (14) and a side release buckle (34). The adjustable strap (120) is formed by attaching a short piece (20), as shown in FIG. 2B to a long piece (22), as shown in FIG. 2A. The short piece (20) and the long piece (22) should be of the same width, preferably 1 inch wide. Preferably, the short piece (20) is approximately 7 feet in length and the long piece (22) is approximately 17.5 feet in length, both the short piece and the long piece being of approximately the same width, preferably 1 inch wide. These dimensions are suitable for conventional doors typically used in homes. However, the adjustable straps may be constructed of different lengths to accommodate the heights of different doors. Typically, doors used in offices are of a longer height, and thus the adjustable strap should accordingly be constructed of a longer length.

In this embodiment the 7 foot short piece (20) is sewn onto the 17.5 foot long piece (22) to form two overlapping pieces of nylon. Preferably, the short piece (20) is positioned, prior to being sewn to the long piece (22), so that an end (700) of the short piece (20) is folded back on itself a distance of approximately 1 inch to form a one inch in length two layer piece of overlapping nylon that is then sewn together to the long piece (22) to form a second three layer stop (602) which functions to impede movement of the adjustable strap (120) upward or through the space between the top (400) of the door (16) and the door frame, when the adjustable strap (120) is secured in position on the door (16). Preferably, multiple rows of stitches (600) secure the three layers together of the second three layer stop (602).

The two overlapping pieces of nylon, formed by the short piece (20) and the long piece (22), are sewn together to form a series of loops (24) on one side of the adjustable strap (120). Preferably each loop (24) is approximately five inches in length and separated from the adjacent loop by preferably three rows of stitches (26) which may be located within approximately a one inch segment (28). Preferably, at the top and bottom of the series of loops, there are multiple rows of stitches connecting the short piece (20) and the long piece (22).

The threads used to sew the overlapping short piece (20) and long piece (22), or used to sew the second three layer stop together may be heavy duty nylon threads, such as nylon #69, nylon 138 or nylon 92. The short piece (20) and long piece (22) may be sewn together by use of an industrial sewing machine. Also, an industrial sewing machine may be used to sew the three layers of the second three layer stop together. After manufacture, the adjustable strap (120) is preferably one continuous heavy duty nylon piece.

As shown in FIG. 11B, the adjustable strap (120) may be attached to the side release buckle (34) by threading the first end (388) of the adjustable strap (120) through the second upper opening (342), around the bar (380) of the side release buckle and through the first upper opening (341) of the side release buckle (34) to form a locking loop (344), which is stitched together approximately two inches from the end of the first end (388) of the adjustable strap to secure the adjustable strap (120) to the first portion (42) of the side release buckle, and leaving free the first end (388) of the adjustable strap, which is folded back on itself to form three layers, which are sewn through together to form a first three layer stop (366), which has preferably a length of approximately one inch. In the foregoing manner, the adjustable strap (120) is secured to the upper portion of the side release buckle (34). The purpose of the first three layer stop (366) is to impede the upward movement of the adjustable strap (120) from entering the space between the top (400) of the door and the door frame when the door is closed. Thus, there is preferably a distance of approximately 2¼ inches of the single layer nylon adjustable strap between the first and second three layer stops, and it is this single layer portion of the adjustable strap which is positioned on top of the door (16). In use this single layer portion of the adjustable strap is positioned on top of the door (16) when the door is in an open position, and when the user has completed his or her use of the strap the strap may be removed from the door after the door is opened.

As further shown in FIG. 11B, the adjustable strap (120) is further attached to the side release buckle (34) by threading the second end (390) of the adjustable strap (120) through the first opening (392) of the lower portion of the side release buckle and then through the second opening (394) of the lower portion of side release buckle. As shown in FIG. 12, the first opening (392) of the lower portion of the side release buckle and the second opening (394) of the lower portion of the side release buckle are used for adjusting the strap to fit the door, as is known in the conventional use of a side release buckle.

As shown in FIG. 11A, the adjustable strap (120) may be attached to the side release buckle (34) by threading it through the first portion (42) of the side release buckle in the opposite direction from that shown in FIG. 11B.

Alternatively, the first and second three layer stops may be constructed in such a manner that a sufficient thickness of strap is formed to function to prevent the movement of the adjustable strap (120) upward through the space between the top (400) of the door (16) and the door frame, when the adjustable strap (120) is secured in position on the door. Thus, the first three layer stop (366) and the second three layer stop (602) are of sufficient thickness to prevent their passage between the top of the door and the door frame when the door is closed. The first three layer stop (366) and the second three layer stop (602) may be made of such other construction as long as each has sufficient thickness to prevent the passage of each between the top of the door and the door frame when the door is closed. In alternative embodiments, the adjustable strap may be constructed without the presence of a three layer stop.

The adjustable strap may be secured to a door by a locking mechanism. The adjustable strap is secured to a door so that the loops (24) are positioned on the side of the door where the user of the device will be positioned. The beginning of the opening of the first loop through which the band may be passed is preferably formed at a distance of approximately 6½ inches from the bar (380) of the side release buckle. In a preferred embodiment the adjustable strap is positioned to circle the height of the door and the locking mechanism is preferably located on the opposite side of the door from where the user of the device will be positioned. The locking mechanism may comprise a locking mechanism known in the art, such as a three or four opening plastic tension lock or a side release buckle (34), as shown in FIGS. 11 A and B, and 12. In the embodiment shown in FIGS. 11A and B, and 12, it is easy to adjust the strap to fit the door by properly positioning the adjustable strap (120) within the first and second openings of the lower portion of the lock (34).

As shown in FIG. 1, after the adjustable strap has been secured to the door, the door is closed and preferably locked. Then, after an elastic band has been threaded through a selected loop, the adjustable strap and band exercise device (10) is ready to be used for exercise. Individuals of different heights and weights can perform a variety of exercises by utilizing the different loop locations on the adjustable strap (12). When the adjustable strap and band exercise device is properly secured to a door, the adjustable strap does not move laterally and the adjustable strap remains in contact with the top and bottom of the door while exercises are performed. When a person is not engaged in the use of the adjustable strap and band exercise device, the door to which the adjustable strap is secured may be opened to allow passage through the door without the necessity to remove the device from the door.

In use the person choosing to exercise would unroll the adjustable strap with attached locking mechanism and secure the adjustable strap to the appropriate vertical surface, such as by placing the adjustable strap around a lockable door or wall unit and using the tension lock to adjust the adjustable strap so it fits the door, wall or other suitable vertical surface. In the embodiment where the adjustable strap is secured to a door, the user would close the door tightly and preferably lock the door in a closed position. Then the user would place a selected exercise band through a selected loop and exercise by pushing or pulling the exercise band through a range of motions. The user may then substitute an exercise band of a different tension from that previously used and select any loop of his or her choice through which to pass the elastic band. The user may then continue to exercise by pushing or pulling that exercise band through a range of motions. The user may continue to choose elastic bands of selected tensions and pass such selected elastic band through any selected loop of the adjustable strap. By selecting different loops and elastic bands of different tensions to be passed through the selected loops, the user may exercise a wide range of muscles.

The adjustable strap and band exercise device (10) can be used to strengthen, tone and tighten muscles. Placement of different tension exercise bands through different of the multiple loops of the adjustable strap allows the user to exercise a wide variety of muscles. The user may select an exercise band and a loop of the adjustable strap through which to place the exercise band. The user may exercise different muscle groups by selecting a different loop through which to place the exercise band. The adjustable strap and band exercise device (10) is suitable for use by a wide variety of people, including for example, male and female adults, children, teenagers and the elderly. Both athletes and non-athletes can use the adjustable strap and exercise device. Athletes can use the adjustable strap and band exercise device to help strengthen certain sport specific muscles. The adjustable strap and band exercise device can be used to rehabilitate muscles by helping to regain strength in various muscles after injury. The adjustable strap and band exercise device may be used to exercise arms, legs, chest, back, shoulders, abdominal muscles and the neck. Both push and pull type exercises can be performed with the adjustable strap and band exercise device by exerting pressure on the elastic band. The adjustable strap and band exercise device is especially useful to individuals who travel frequently, such as business travelers, because of the easy portability of the device.

The adjustable strap and band exercise device is portable, light weight, easy to store and compactable. After the user has completed his or her exercises with the adjustable strap and band exercise device, the user may unthread the adjustable strap from the locking mechanism and detach the adjustable strap and band exercise device from the door or wall unit. The user may roll the adjustable strap into a coil to form a compact strap which may then be easily carried or conveniently stored, in for example, a pocket, purse, briefcase, suitcase, dress or desk. The adjustable strap and band exercise device is portable and thus may be used at home, in a rehabilitation center, at work, in a gymnasium, in a hotel or any place that has a door or suitable structure for attachment.

What is claimed is:

1. A portable exercise device comprising: an elastic band and an adjustable strap, said adjustable strap comprising two sides and having a plurality of loops along one side of the adjustable strap which allows the passage therethrough of said elastic band, said adjustable strap being of a length sufficient to allow the adjustable strap to encircle a door vertically such that said plurality of loops are positioned on one side of the door, wherein said plurality of loops are in linear series, said elastic band being passed through one of the plurality of loops, and a locking mechanism which allows the adjustable strap to be attached to a door, a locking mechanism providing a tight fit between said adjustable strap and said door by permitting said adjustable strap to be tightened about said door, said one side of said adjustable strap which has said loops comprising a short piece which is sewn onto a long piece to form said loops by sewing said long piece and said short piece together at vertically spaced locations.

2. The portable exercise device of claim 1 wherein said plurality of loops extend along the height of said door.

3. The portable exercise device of claim 2 further comprising at least one thickened section of said adjustable strap which thereby prevents the upward movement of said adjustable strap into a space between the top of said door and a door frame when said door is closed in said door frame.

4. The portable exercise device of claim 2 wherein said plurality of loops are spaced approximately equidistantly one from the other on one side of said door.

* * * * *